United States Patent [19]

Sjödin

[11] 4,158,766

[45] Jun. 19, 1979

[54] INSPECTION OF ELONGATED WORKPIECES SUCH AS RANDOM LENGTH BOARDS

[75] Inventor: Bo Sjödin, Jönköping, Sweden

[73] Assignee: Saab-Scania Aktiebolag, Linkoping, Sweden

[21] Appl. No.: 889,199

[22] Filed: Mar. 23, 1978

[30] Foreign Application Priority Data

Mar. 25, 1977 [SE] Sweden ..... 7703417

[51] Int. Cl.[2] ..... G06M 3/06; G06M 7/00

[52] U.S. Cl. ..... 235/92 DN; 235/92 DP; 235/92 V; 235/92 MP; 235/92 R

[58] Field of Search ..... 235/92 QC, 92 DN, 92 EV, 235/92 DP, 92 V, 92 MP; 356/237, 156

[56] References Cited

U.S. PATENT DOCUMENTS

| | | | |
|---|---|---|---|
| 3,261,967 | 7/1966 | Rosin et al. | 235/92 DN |
| 3,548,168 | 12/1970 | Beck | 235/92 DN |
| 3,898,469 | 8/1975 | Nichols et al. | 235/92 QC |
| 3,931,498 | 1/1976 | Bowler | 235/92 DN |

*Primary Examiner*—Joseph M. Thesz

[57] ABSTRACT

For enabling a computer to calculate locations of cuts across an elongated workpiece that will divide it into standardized length finished pieces of optimum economic value, the workpiece is established between parallel, spaced boundaries of an inspection zone, lengthwise parallel to them. From a movable light source a beam is projected down onto the inspection zone that defines a line of illumination extending from one to the other of the boundaries. A manually operable control member, movable parallel to the boundaries, actuates the light source to move the line of illumination lengthwise along a workpiece. An output is produced that has a unique magnitude for each incrementally different position of the line of illumination. When the line of illumination is located at a boundary between unlikequality lengthwise extending portions of the workpiece, actuation of a pushbutton delivers the then-existing output magnitude to the computer as an input.

8 Claims, 2 Drawing Figures

INSPECTION OF ELONGATED WORKPIECES SUCH AS RANDOM LENGTH BOARDS

Figure 1:
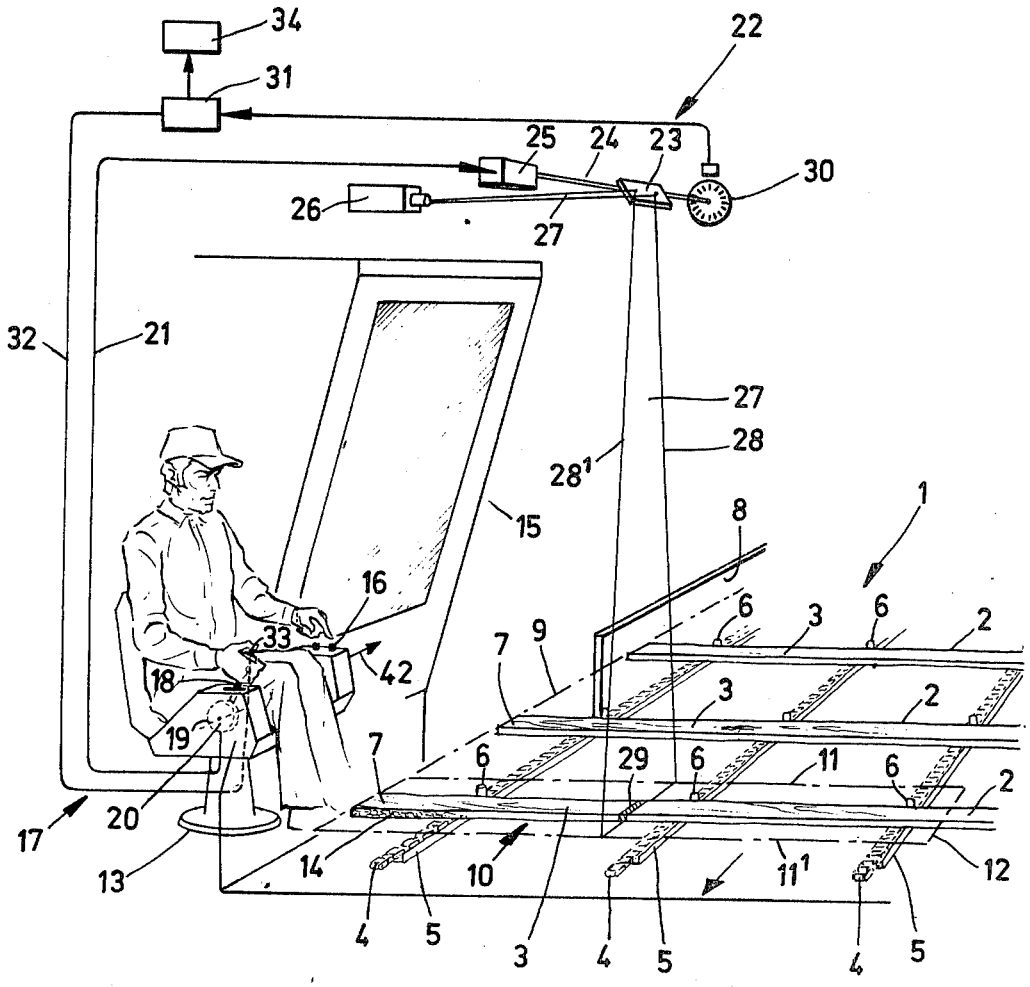

This invention relates to the lengthwise trimming of random-length elongated workpieces such as boards and other lumber workpieces to reduce them to modular or other desired finished lengths; and the invention is more particularly concerned with a method and apparatus for feeding information to a computer concerning each of a succession of random-length workpieces to enable the computer to calculate, for each workpiece, the location of one or more transverse cuts that will remove from the workpiece all portions along its length that are of unacceptable quality while at the same time reducing it to one or more finished pieces that constitute the economically optimum yield obtainable from it.

Although the present invention is of value in various types of length trimming operations, its advantages are best appreciated and its principles are most easily understood in relation to the inspection and trimming to length of random-length boards in a lumber sawmill; and accordingly the invention is described in connection with that specific operation. However, it will be understood that this is merely by way of an appropriate example.

In a sawmill, boards are first finished as to their width and thickness dimensions, and then the random-length boards are brought to an inspection station at which an evaluation is made of each board with respect to variations in quality along its length. On the basis of such evaluation, a determination is made of the finishing cut or cuts that must be made across the board to remove all portions that are of unacceptable quality.

The evaluation of each workpiece that must be made at the inspection station is a complicated one. Along one portion of its length a board may be of unacceptable quality in that it is undersize in width or thickness or may have a waney edge or may be otherwise defective. Another portion of the same workpiece may be acceptable but of inferior quality. A third portion of the same board may be of the highest quality. Such variation of quality along the length of the workpiece—which is quite usual—poses the problem of how to trim the workpiece to length in such a way as to obtain the economically optimum finished product from it. The unacceptable portion or portions of the workpiece must of course be discarded. For some purposes the length or lengths of the finished piece or pieces must be standardized, and in such cases it is usually necessary, also, to discard a small amount of additional material so that the finished product will conform to an established system of standard lengths or of length modules. In many cases there is the further problem of determining whether to trim the workpiece in such a manner as to produce a long board that will be of acceptable but inferior quality or to cut the workpiece down to a shorter length that will merit a prime quality rating. The optimum solution to this problem is determined not only by the peculiarities of the individual workpiece but also by market conditions that are constantly varying.

The evaluation of quality requires an experienced human eye, but even without a requirement for standard-length finished products, it is too much to expect that an operator who makes a quality appraisal shall also possess the necessary knowledge of market conditions and the ability to perform lightning-fast calculations that would enable him to control the locations of the trimming cuts with assurance that economically optimum yield would be obtained in every case.

Heretofore there have been attempts to assist the operator in determining the location of the trimming cuts, but such methods and apparatus as have been devised for that purpose have served only to define for the operator standardized lengths to which the workpiece could be cut, and they have afforded no real assistance in solving the more difficult part of the problem that involves calculation of economic factors. One known expedient of this type comprises an arrangement of light sources mounted above the inspection zone and projecting a series of lines of illumination down onto a workpiece in that zone to subdivide the inspection zone according to a modular system upon which standardized lengths were based. The operator had a series of buttons that corresponded to the respective modular subdivisions, and by pressing these selectively for each workpiece he produced an input corresponding to the number of such modular units that were to be contained in the finished unit to be cut from the workpiece. Other pushbuttons allowed quality data to be fed to a computer so that it could make a calculation of the presumably optimum utilization of a workpiece whereby it determined, for example, whether the finished board was to have many modular units but to include some defects that lowered its overall quality or was to be cut to a shorter finished length of higher overall quality plus (if the condition of the workpiece permitted) a useable board of lower quality.

This prior method and apparatus was necessarily tied to a relatively large module unit—typically 300 mm.—so that the operator would not have to contend with an unwieldy number of modules. Furthermore, its modular system was essentially fixed in its relationship to the individual workpiece; hence, if a defect in a workpiece was situated just inside the limits of a module defined by illumination lines, the operator had to locate a saw cut at the nearest modular limit on the "good" side of the defect, thus requiring that the whole of the module containing the defect be included in the offcut or in a lower quality board cut from the workpiece. Furthermore, if there was doubt about whether a defect was located inside or outside a module boundary, there was a tendency for the operator to decide in favor of a finished piece that would be too short, as against one that might be long enough to include the defect. Errors also arose from pushing incorrect buttons, with the result that there was a certain amount of inadvertent wasteage. Obviously the prior system was not well suited to production of finished pieces that did not have to be cut to modular lengths but did have to be cut to such running lengths as would yield the maximum economic value from the available material.

The present invention is based upon the logical premise that the quality of a workpiece, or any portion thereof, can be satisfactorily appraised only by the human eye, whereas, within the limited time that is practically available, only a computer can satisfactorily perform the calculations required for determining the locations of cuts that will yield economically optimum products. However, for the computer to produce useful results, it must receive inputs that accurately correspond to the quality evaluation made by the human operator, and the operator must be able to supply such inputs to the computer quickly, accurately and efficiently.

Thus the general object of the present invention is to provide a method and means for enabling a human operator to identify to a computer those portions of an elongated workpiece along the length thereof that are of unacceptable quality and also, if desired, those portions that are of acceptable but inferior quality, and for enabling such identifying information to be fed to the computer in the form of signals corresponding to a length of lengths along the workpiece measured from a reference line having a known relationship to the length of the workpiece, so that the computer can employ such information, together with stored data relating to prevailing market prices and—where applicable—to length requirements such as length module standards, for the purpose of calculating the cut to cuts across the workpiece that will yield a finished piece or pieces of the optimum obtainable economic value.

It is also an object of this invention to provide a method and means for use in trimming successive random-length workpieces to economically optimum length, whereby a human operator is required to make only quality judgments in the course of inspecting each workpiece along its length, so that all other calculations and decisions concerning the trimming operation can be made by the computer, whereby the operator is enabled to communicate his quality judgments to the computer in a very natural and convenient manner that nevertheless makes the information quickly available to the computer in a form that can be readily utilized by it.

Another object of the invention is to provide a convenient, accurate and easily practiced method, capable of being implemented by relatively simple and inexpensive means, for feeding to a computer input data based upon visual observation of quality of different portions of a workpiece along the length thereof, whereby the operator is enabled to concentrate his attention upon inspection of each workpiece and evaluation of the quality of each part of it, and whereby the operator can transmit to the computer the information obtained from his inspection in a manner which does not distract him from the task of inspection and evaluation and therefore allows him to inspect numerous workpieces in rapid succession with a minimum of fatigue.

It is also an object of this invention to provide a method and means for inspecting elongated workpieces that attains the above stated objectives, and, further, avoids possibilities for inputs of erroneous or inaccurate data to the computer.

It will be apparent that the ultimate objective of the invention is to achieve a significant conservation of valuable timber resources by avoiding a substantial amount of wasteage of useable material in the lengthwise trimming of elongated workpieces whereby their portions that are of unacceptable or inferior quality are cut away.

Considering the invention in its method aspect, its objects are attained by establishing each workpiece, in turn, in an inspection zone defined by parallel spaced apart boundaries, with the workpiece located between said boundaries and extending lengthwise parallel to them and with one end of the workpiece fixed in relation to a predetermined reference line that extends transversely to said boundaries; producing a light beam which shines substantially downwardly into the inspection zone and which extends substantially from one to the other of said boundaries but is substantially narrow in directions parallel to said boundaries to provide a transverse line of illumination across a workpiece at the inspection zone; manually moving said light beam in directions parallel to said boundaries to shift said line of illumination lengthwise along the workpiece; producing an output having a magnitude so corresponding to the position of said line of illumination in relation to said reference line that said output has a unique magnitude for each incrementally different distance between said line of illumination and said reference line; and, when the line of illumination is at a location along the workpiece that is at the boundary between lengthwise adjacent portions of the workpiece which are of unlike quality, feeding to a computer, as an input, the output magnitude then prevailing and which signifies the distance from said reference to said line of illumination.

Considering the invention in its apparatus aspect, its objects are attained by inspection zone means comprising supporting means whereby a workpiece can be supported with its length extending substantially horizontally, orienting means for disposing the workpiece lengthwise parallel to and between spaced apart parallel boundaries of an inspection zone, said zone having a reference line which extends transversely to said boundaries; movable light source means located above the inspection zone for producing a light beam which shines substantially downwardly and is substantially narrow in the direction parallel to said boundaries but extends substantially from one to the other of them, so that said beam provides a line of illumination parallel to said reference line across a workpiece at said inspection zone; light source actuating means comprising a manually operable control member movable in opposite directions parallel to said boundaries, and coordinating means connected between said control member and said light source means for constraining the light source means to such motion that said line of illumination is moved parallel to said boundaries and in correspondence with movement of the control member; output producing means operatively associated with said light source actuating means for producing an output having a magnitude which varies in correspondence with movement of the light source means and which has a unique value for each of a succession of incrementally different distances between said line of illumination and said reference line; and manually operable input means connected with said output producing means for transiently connecting the output producing means with a computer to enable the prevailing magnitude of said output to be fed to the computer as an input.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

Figure 2:
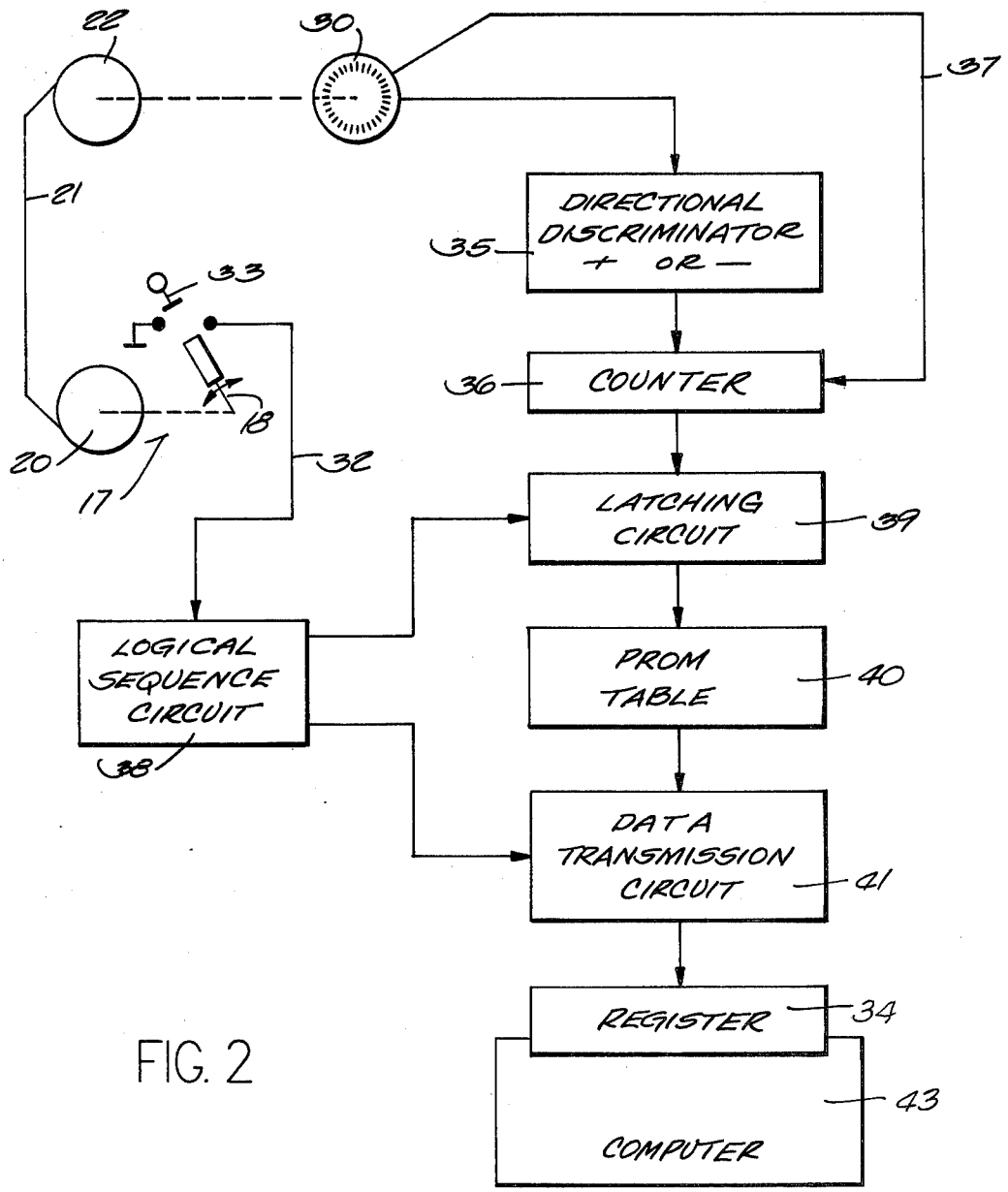

The accompanying drawings illustrate one complete example of an embodiment of the invention constructed according to the best mode so far devised for the practical application of the principles thereof and in which:

FIG. 1 is a perspective view illustrating more or less schematically an inspection installation for random length workpieces that embodies the principles of this invention; and FIG. 2 is a simplified block diagram illustrating how the electrical part of the installation can be embodied.

Referring now to the accompanying drawings, the numeral 1 designates generally a conveyor by which random length boards 2 or similar elongated workpieces are carried to and through an inspection zone which is designated generally by 10 and which is located at an inspection station and is defined as explained hereinafter. As shown, the conveyor 1 comprises a plurality of chains 4 that have parallel horizontal upper stretches running in guides 5 whereby said chain stretches are disposed in a common horizontal plane, and the several chain stretches are all driven in unison and in the same direction. The workpieces 2 rest on these upper chain stretches, extending transversely across them, and each workpiece has a flat side 3 uppermost.

Each workpiece 2 is established and maintained in an orientation lengthwise transverse to the chains by means of pushers 6 on the chains, arranged to project upward from the upper stretches. The pushers 6 on the several chains are arranged in rows, so that each workpiece has the proper orientation if its rear edge engages a pusher on each chain. The several pushers along each chain are spaced apart by uniform distances substantially greater than the width of a workpiece so that the workpieces are carried one by one through the inspection zone 10 with adequate intervals between successive workpieces.

As the workpieces 2 are advanced towards the inspection zone 10 by the conveyor, they are end-aligned in a known manner whereby one end edge 7 of each is caused to engage an upright positioning guide 8 that extends parallel to the chain stretches and is wholly disposed ahead of the inspection zone along the conveyor path. Every workpiece therefore moves through the inspection zone 10 with its end edge 7 lying on a reference line 9 that is aligned with the positioning guide 8 and extends parallel to the chain stretches.

The inspection zone 10 comprises a portion of the conveyor path that lies between parallel boundaries 11, $11^1$ which extend transversely to the reference line 9 and which are spaced apart by a distance greater than the maximum expectable width of a workpiece but not greater than the distance between successive pushers 6 along a chain stretch. The boundaries 11, $11^1$ of the inspection zone need not be visibly delineated, but they are defined as explained hereinafter. It is likewise unnecessary that the reference line 9 be visible as such, since it is defined by the ends 7 of the workpieces. The reference line 9 of course defines one end of the rectangular inspection zone 10, the other end of which is designated by a line 12 that also need not be delineated.

At a suitable location at the inspection station, adjacent to the inspection zone, there is provided a chair 13 for an operator who is to perform quality appraisals on workpieces passing through that zone. As shown, the operator's chair 13 is located just outside the inspection zone, between extensions of the boundaries 11, $11^1$ and near the reference line 9, but the chair could also be located somewhat downstream from the inspection zone and midway between its ends 9 and 12. In any event, the chair 13 should be placed at such an elevation relative to the plane of the upper chain stretches that the operator can have the entire inspection zone conveniently within his field of view. Lumber workpieces are preferably placed on the conveyor with their root ends away from the operator so that waney portions 14 and similar defects, which are most likely to appear near the top ends of such workpieces, are closest to the operator. For environmental reasons, the chair 13 is preferably situated in an enclosed cab 15 having an adequately large window through which the operator can view the whole of every workpiece in the inspection zone.

As illustrated, the chair 13 is specially equipped with control instrumentalities on both of its arms, where they are convenient to an operator seated in the chair, but it will be apparent that these control instrumentalities could instead be mounted, for example, on a panel or console (not shown) in front of the chair. The control instrumentalities comprise a lever 18 or similar control member that can be manually actuated in directions parallel to the inspection zone boundaries 11, $11^1$, a momentary contact switch actuator 33 which is preferably in the form of a pushbutton mounted on the control member 18, and certain pushbuttons 16 which are preferably mounted on the opposite arm of the chair from the control member 18.

The control member 18 is incorporated in a master unit 17 and serves for actuating movable light source means 23–26 and a transducer 30 that comprise a slave unit 22. The movable light source means, which is located at the inspection station, above the inspection zone 10, comprises, as shown, a light source 26 from which a beam of light 27 is projected, and a plane mirror 23 mounted to swing about a fixed horizontal axis 24 that is parallel to the reference line 9. The beam 27 from the light source 26 is directed towards the mirror 23, which reflects it in a generally downward direction onto a workpiece in the inspection zone.

The light source 26, which can be a laser transmitter or a light projector, is equipped with such lenses, and so cooperates with the mirror 23, that the downwardly reflected portion of the light beam that falls upon the inspection zone has a very small extension in directions parallel to the inspection zone boundaries 11, $11^1$ but extends from one to the other of said boundaries and thus provides a line of illumination 29 across the top surface 3 of a workpiece in the inspection zone. It will be apparent that the line of illumination 29 is parallel to the reference line 9 and that swinging of the mirror 23 moves the line of illumination lengthwise along the inspection zone, i.e., parallel to the boundaries 11, $11^1$. Preferably the movable light source means produces a colored illumination that affords better contrast than white light against the upper surfaces 3 of workpieces. Since the opposite edges 28, $28^1$ of the light beam 27 fall on the inspection zone at its boundaries 11, $11^1$, those boundaries are defined for the operator by the loci of the ends of the line of illumination 29 as that line moves in the inspection zone.

Through a connection 21, the movable light source means 23–26 is so controlled from the master unit 17 that swinging of the mirror 23 is slaved to movement of the manual control member 18. The connection 21 between the master unit 17 and the slave unit 22 could be a purely mechanical one, comprising coordinating means such as a cable and pulley arrangement; but as shown the master unit comprises a position transducer 20 that issues a signal corresponding to the existing position of the control member 18, the coordinating connection 21 comprises electrical conductor means, and the slave unit comprises a receiving angle transducer or servo 25 which responds to signals from the transmitting transducer 20 and rotates the mirror 23 in correspondence with movement of the control member 18.

The manually operated control member 18 should be movable in the same directions as the line of illumination 29 so that the operator's actions for control of the position of the line of illumination are natural ones. Preferably the range of motion of the control member 18 is in a suitable manner confined within limits that correspond to the ends 9 and 12 of the inspection zone, which constitute the limits of travel of the line of illumination. If desired, the control member 18 can be biased in one direction of its motion or can be biased towards a predetermined position intermediate its limits of motion.

It will now be apparent that an operator seated in the chair 13 can very accurately control the position of the line of illumination 29 along the length of a workpiece in the inspection zone simply by actuating the control member 18 in a natural manner. As the line of illumination moves, an output is produced, as explained hereinafter, which at all times corresponds to the location of the line of illumination in relation to the reference line 9. When the operator has established the line of illumination 29 at a boundary between acceptable and unacceptable portions along the length of a workpiece, he actuates the pushbutton switch 33 and thereby effects issuance of an "enter" signal whereby the then-prevailing value of the output just mentioned is fed as an input to signal processing circuits which are generally designated by 31 in FIG. 1 and which are illustrated in more detail in FIG. 2. The output of the apparatus 31 is in turn fed to a register 34 that can comprise a part of a computer 43 that controls the subsequent cutting of the board.

If the control member 18 is a hand lever mounted on the right arm of the chair 13, as shown, the actuator for the pushbutton 33 can be mounted at the top of it, to be accessible to the operator's right thumb.

The above mentioned pushbuttons 16, shown as mounted on the left arm of the chair 13, can be used to deliver to the computer 43 signals that denote various degrees of quality. Thus, in addition to using the pushbutton 33 to designate to the calculating apparatus the boundary line between acceptable and unacceptable portions of a workpiece, the operator can push an appropriate one of the pushbuttons 16 corresponding to the quality class that should be assigned to the finished product, to send a class classification input to the computer 43, as denoted by arrow 42. In such a procedure, two pairs of quality determinations can be made for a workpiece, one applying to a longer finished board of lower quality and the other applying to a shorter board of higher quality, and the computer determines the alternative to be selected, on the basis of an optimum price calculation. For such a classification procedure it may be desirable to have each workpiece remain stationary in the inspection zone for a long enough interval to give the operator time to make a complete quality assessment.

Actuation of the pushbutton 33 causes ultimate delivery to the register 34 of information in the form of an output having a magnitude which corresponds to the then-existing position of the line of illumination 29 in relation to the reference line 9. That output is produced by output means comprising an angle-sensing transducer 30 which is so connected in the master-slave system as to respond to the angular position of the mirror 23. The transducer 30 can be a resolver which is coaxially coupled with the mirror and its actuating transducer 25 and which issues an analogue signal that corresponds to the angular position of the mirror.

As illustrated, however, the angle sensing transducer 30 is arranged to produce a digital output and is in the form of a device which issues a pulse each time the mirror is swung through a predetermined and relatively small increment of angular motion. In this case the output producing means also comprises a counter 36 (see FIG. 2) which receives and counts the pulses issued by the transducer 30. However, in order for the value of the count that is stored in the counter 36 at any instant to bear an accurate relationship to the then-existing distance between the reference line 9 and the line of illumination 29, account must also be taken of the direction in which the line of illumination has been moved in relation to the reference line. To that end the incremental transducer 30 is connected with the counter 36 through a directional discriminator 35 that operates in a conventional manner to give a plus sign to each pulse from the transducer 30 when that transducer is moving in one direction and a minus sign to each pulse resulting from motion in the opposite direction. The counter 36 adds the pulses algebraically (taking account of their signs) so that the count contained in it will at every instant constitute a magnitude that corresponds to the angular position of the mirror and hence to the location of the line of illumination 29 along the length of the workpiece.

The incremental transducer 30 is preferably so arranged that whenever it passes through a reference or datum angle position it issues a zeroing pulse which is imposed upon the counter 36 by way of a zeroing connection 37 and brings the contents of the counter to zero. In this manner compensation is made for false pulses or missed pulses, so that these do not accumulate in the counter and give rise to a constant error in position information. Obviously the counter could be reset to some value other than zero if the resetting pulse issued over the connection 37 were produced at a suitably corresponding point in the response range of the transducer 30.

The pushbutton 33, by which the operator issues an "enter" signal to the apparatus, is connected by means of a signal line 32 with a logical sequence unit 38 which ensures that the different functions for transfer of information to the computer 43 will take place in the correct time sequence; and through that sequence unit 38, actuation of the pushbutton 33 causes a latching circuit 39 to read the contents of the counter 36 at the moment when the "enter" signal is issued.

It will be evident that the incremental distances denoted by successive pulses from the angle transducer 30 are angular distances and therefore do not directly correspond to uniform linear distance increments along a workpiece at the inspection zone. Thus, a given angular increment at the ends of the operating range of the slave unit, where the light beam 27 has a considerable inclination to the plane of the conveyor will represent a greater distance along the length of the inspection zone than the same angular increment would represent at the middle of the zone where the light beam is substantially vertical. To effect the necessary correction whereby the information stored in the counter 36 is converted to the required distance information, the latching circuit 39 addresses a so-called PROM-table 40, which, as is generally conventional, comprises a series of pairs of mutually associated data, one of which represents a measured angular position of the light beam 27 and the other of which designates the corresponding position of the line of illumination 29, given in terms of applicable length units and measured in relation to the reference line 9 or a datum line having a known relationship to it.

It is not essential that the workpieces passing through the inspection zone be end-aligned as shown. Some fixed reference line must of course be established at the inspection zone that is transverse to the boundaries 11, 11[1]; and either before or after passage through the inspection zone a measurement would be made for each workpiece to determine the distance from one of its ends to the reference line. On the basis of the last-mentioned distance measurement, the data for each workpiece obtained by means of the line of illumination 29, although taken in relation to the reference line, could be readily so corrected or translated as to be related to said end of the workpiece as a datum line. It will be understood that the workpieces would be confined to translatory motion transverse to their lengths not only through the inspection zone but also between that zone and the station at which the locations of their ends was measured.

Under the control of the logical sequence unit 38, the value read out of the PROM-table 40 goes directly to a data transmission circuit 41 which converts the output to either parallel or series form, in accordance with requirements for input to the computer 43, and then transfers the information to the register 34 for input to the computer 43 at the proper time.

It will be understood that the computer 43 can be one which supervises the complete manufacturing process, including operations performed on the workpieces before they arrive at the inspection zone 10, and which also issues outputs that control the remaining operations performed upon the workpieces after they leave the inspection zone and move to a cutting station (not shown) where each in turn is automatically cut into one or more finished pieces of optimum available economic value.

The signal processing apparatus illustrated in FIG. 2 can obviously be modified in various respects. For example, if a microcomputer is used to control only the cutting operation, the logical sequence unit 38 would not be needed, and the signal line 32 could be connected directly to the microcomputer. An input/output circuit would be connected between the microcomputer and the counter 36 so that the microcomputer could read angle information off of the counter more or less directly, after which the microcomputer could carry out a trigonometric calculation to convert the mirror angle information obtained from the counter into distance magnitudes that it would further process in conjunction with other data in calculating optimum locations for cuts. If, as mentioned above, an analogue angle transducer is used for sensing the angular position of the mirror 23, then of course the counter 36 would not be needed but would be replaced by an analogue-to-digital converter.

It will also be apparent that movement of the line of illumination 29 can be effected by other means than the illustrated one comprising the swinging mirror 23. Although it is conceivable that a suitable light beam projector aimed vertically downwardly could be bodily translated lengthwise of the inspection zone, a projector so arranged would be likely to have too much inertia to move fast enough for production efficiency. The entire inspection of a workpiece should take place within a few seconds. A more desirable alternative would be to employ a fibre optic rod connected to a fixed light source at one end and having its other end directed generally downwardly towards the inspection zone and arranged to be pivotable in generally the same manner as the mirror 23. Suitable means would be arranged at the swingable end of the rod (e.g., a cylindrical lens) for imparting the desired form to the light beam.

It will be apparent that the main tasks of the operator are to visually inspect each workpiece on the conveyor as it passes the inspection zone, to take account of the defects and pecularities visible on the upper surface 3 of the workpiece that are significant for classification of finished articles, and to so manipulate the control member 18 and the pushbuttons 16 and 33, as explained above, that inputs are fed to the computer which signify the locations of hypothetical cuts across the workpiece that will divide its length into segments in accordance with the prevailing system of quality classification. The operator need not concern himself with modular or standardized lengths, inasmuch as the computer determines the locations of the actual cuts to be made across the workpiece, which may or may not coincide with the hypothetical cuts denoted by the inputs that the operator has caused the computer to receive. And of course the operator has no reason to be concerned about relationships between quality and price.

It will be apparent that the time available to the operator for making an evaluation of a single workpiece depends upon the speed of the conveyor and upon the width of the inspection zone between its boundaries 11, 11[1], which width is equal to the width of the light beam 27. The inspection zone 10 is made substantially wider than the widest expectable workpiece, so that the operator can have time to press the button 33 before he "loses" the workpiece and while he has the line of illumination 29 on the workpiece to assist him. Similarly, to avoid the distraction of having two workpieces in the inspection zone at the same time, successive pushers 6 on the chains are spaced apart by distances somewhat greater than the width of the inspection zone.

The rapidity and accuracy of the inspection and evaluation procedure are enhanced by the movement of the illumination line 29 in the same direction as the manual control 18 and in synchronism with it. The operator can cause the illumination line to sweep all along the upper surface of the workpiece to guide his eye as he evaluates quality and searches for defects, and he can then quickly and easily bring the line of illumination back to each position at which an input is to be fed to the computer.

From the foregoing description taken with the accompanying drawings it will be apparent that this invention provides a simple and efficient method and means for enabling an operator to feed inputs to a computer that designate the locations of hypothetical cuts across an elongated workpiece whereby portions along the workpiece that are of differing quality would be separated from one another, which inputs can be utilized by the computer in conjunction with data concerning demanded lengths and pricing information to calculate the locations of the actual cut or cuts that should be made across the workpiece to reduce it to one or more finished pieces that will provide the economically optimum yield available from the workpiece.

Those skilled in the art will appreciate that the invention can be embodied in forms other than as herein disclosed for purposes of illustration.

The invention is defined by the following claims.

I claim:

1. In a process wherein random length elongated workpieces such as boards and other lumber pieces, each of which may be of unacceptable quality along a portion of its length, are trimmed to finished pieces that are wholly of acceptable quality, a method of producing an input which can be fed to a computer and which signifies a location along the length of a workpiece at which a hypothetical cut transverse to its length will effect minimum reduction of its length while removing all portions of unacceptable quality that are adjacent to one of its ends, which input enables the computer to calculate the location of an actual cut that will yield the optimum standardized-length finished piece obtainable from the workpiece, said method being characterized by:

A. establishing each workpiece, in turn, in an inspection zone defined by parallel, spaced apart boundaries,
   (1) with the workpiece located between said boundaries and extending lengthwise parallel to them and
   (2) with one end of the workpiece in a known relationship to a reference line that extends transversely to said boundaries;

B. producing a light beam which shines substantially downwardly onto said inspection zone and which extends substantially from one to the other of said boundaries but is substantially narrow in directions parallel to said boundaries, to provide a transverse line of illumination across a workpiece at the inspection zone;

C. manually moving said light beam in directions parallel to said boundaries to shift said line of illumination lengthwise along said workpiece;

D. producing an output having a magnitude so corresponding to the position of said line of illumination in relation to said reference line that said output has a unique magnitude for each incrementally different distance between said line of illumination and said reference line; and E. when the line of illumination is established at a location along a workpiece that is proper for a hypothetical cut, feeding to the computer, as an input, the output magnitude then obtaining and which signifies the distance from said reference line to said line of illumination.

2. The method of claim 1, wherein said output is produced by:
   (1) producing a pulse each time said light beam is moved through a predetermined distance increment,
   (2) feeding said pulses additively to a counter during motion of the light beam in one direction, and
   (3) feeding said pulses subtractively to the counter during motion of the light beam in the opposite direction, so that the magnitude of the contents of the counter always corresponds to the position of said line of illumination in relation to said reference line.

3. The method of claim 2 wherein said output magnitude is fed to the computer as an input by:
   manually producing an enter signal which releases the contents of the counter to the computer.

4. The method of claim 1, wherein each workpiece is established, in turn, at said inspection zone by:
   conveying workpieces to said inspection zone with a translatory motion, with the workpieces oriented lengthwise parallel to said boundaries and moving to and through the inspection zone in one direction transverse to their lengths, and with successive workpieces spaced apart by substantial distances in said direction.

5. In apparatus whereby random length elongated workpieces such as boards and other lumber pieces, each of which may be of unacceptable quality along a portion of its length, are trimmed to finished pieces that are wholly of acceptable quality, means for producing an input which can be fed to a computer and which signifies a location along the length of a workpiece at which a hypothetical cut transverse to its length will effect minimum reduction of its length while removing all portions of unacceptable quality that are adjacent to one of its ends, which input enables the computer to calculate the location of an actual cut that will yield the optimum standardized-length piece obtainable from the workpiece, said means comprising:

A. inspection zone means comprising
   (1) supporting means by which a workpiece can be supported with its length extending substantially horizontally,
   (2) orienting means for disposing the workpiece lengthwise parallel to and between spaced apart parallel boundaries of an inspection zone, and
   (3) means for defining a reference line which extends transversely to said boundaries;

B. movable light source means located above said inspection zone for producing a light beam which shines substantially downwardly and is substantially narrow in the direction parallel to said boundaries but extends substantially from one to the other of them, so that said beam provides a line of illumination parallel to said reference line across a workpiece at said inspection zone;

C. light source actuating means comprising
   (1) a manually operable control member movable in opposite directions parallel to said boundaries and
   (2) coordinating means connected between said control member and said light source means, for constraining said light source means to such motion that said line of illumination is moved parallel to said boundaries and in correspondence with movement of said control member;

D. output producing means operatively associated with said light source actuating means, for producing an output having a magnitude which varies in correspondence with movement of the light source means and which has a unique value for each of a succession of incrementally different distances between said line of illumination and said reference line; and E. manually operable input means connected with said output producing means for transiently connecting the output producing means with a computer to enable the prevailing magnitude of said output to be fed to the computer as an input, so that when the line of illumination is in a position along a workpiece deemed proper for a hypothetical cut, the output magnitude then obtaining, and which signifies the then-existing distance from said reference line to the line of illumination, can be fed to the computer as an input.

6. The apparatus of claim 5 wherein said output producing means comprises:
   (1) transducer means for producing a pulse each time said light source means is moved through a predetermined distance increment;
   (2) a counter; and
   (3) means so connecting said transducer means with said counter as to feed pulses from the transducer means to the counter additively during movement of the light source means in one direction and subtractively during movement of the light source means in the opposite direction.

7. The apparatus of claim 5, further characterized by:

(1) said supporting means comprising a conveyor by which workpieces are brought to the inspection zone in a direction transverse to said boundaries; and (2) said orienting means comprising pushers on said conveyor that are arranged in sets, each set comprising at least two pushers and the pushers of the set being on a line parallel to said boundaries for engagement by a lengthwise extending edge portion on a workpiece to orient the workpiece lengthwise parallel to said boundaries, and said sets being spaced apart in the direction of said reference line by distances substantially greater than the widths of the workpieces.

8. The apparatus of claim 5, further characterized by:

(1) said manually operable control member comprising a lever; and (2) said input means comprising a pushbutton switch mounted on said lever.

* * * * *